US010041330B2

(12) United States Patent
Vick, Jr.

(10) Patent No.: US 10,041,330 B2
(45) Date of Patent: Aug. 7, 2018

(54) STACKED PISTON SAFETY VALVES AND RELATED METHODS

(75) Inventor: James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 748 days.

(21) Appl. No.: 14/407,767

(22) PCT Filed: Jul. 30, 2012

(86) PCT No.: PCT/US2012/048821
§ 371 (c)(1),
(2), (4) Date: Mar. 20, 2015

(87) PCT Pub. No.: WO2014/021816
PCT Pub. Date: Feb. 6, 2014

(65) Prior Publication Data

US 2015/0191995 A1 Jul. 9, 2015

(51) Int. Cl.
*E21B 34/10* (2006.01)
*E21B 34/00* (2006.01)

(52) U.S. Cl.
CPC ..... *E21B 34/10* (2013.01); *E21B 2034/007* (2013.01)

(58) Field of Classification Search
CPC ..... E21B 34/10–34/108
See application file for complete search history.

(56) References Cited

U.S. PATENT DOCUMENTS 4,621,695 A 11/1986 Pringle
4,660,646 A 4/1987 Blizzard
4,838,355 A * 6/1989 Leismer ..... E21B 34/10 166/319
5,310,004 A 5/1994 Leismer
6,237,693 B1 5/2001 Deaton
6,491,106 B1 12/2002 Simonds
7,347,270 B2 3/2008 McMillan et al.
2005/0178559 A1 8/2005 Jacob
(Continued)

OTHER PUBLICATIONS

European Search Report received in corresponding EP Application No. 12882199, dated Jun. 7, 2016.
(Continued)

*Primary Examiner* — D. Andrews
(74) *Attorney, Agent, or Firm* — McDermott Will & Emery LLP

(57) ABSTRACT

Disclosed is a safety valve with redundant operators or systems. One safety valve includes a piston bore in fluid communication with a first control line via first control line port and a second control line via a second control line port, the first and second control lines conveying hydraulic fluid pressure to the piston bore. First and second piston assemblies are movably arranged within the piston bore and the second piston assembly includes a transition member coupled thereto. A flow tube is arranged adjacent the transition member and moves axially within a flow passage defined in the safety valve in response to the movement of the transition member. A valve closure device moves between an open position and a closed position restricts fluid flow through the flow passage when in the closed position, the flow tube being adapted to shift the valve closure device between open and closed positions.

25 Claims, 4 Drawing Sheets

(56) References Cited

U.S. PATENT DOCUMENTS

| | | | | |
|---|---|---|---|---|
| 2006/0070744 | A1 | 4/2006 | Smith | |
| 2006/0086509 | A1 | 4/2006 | McMillan | |
| 2008/0128137 | A1* | 6/2008 | Anderson | E21B 34/101 166/319 |

OTHER PUBLICATIONS

Patent Examination Report No. 1 received in corresponding AU Application No. 2012386592, dated Jun. 24, 2016.
International Search Report and Written Opinion for PCT/US2012/048821 dated Mar. 28, 2013.

* cited by examiner

STACKED PISTON SAFETY VALVES AND RELATED METHODS

BACKGROUND

The present invention relates generally to operations performed and equipment utilized in conjunction with a subterranean well and, in particular, to safety valves having redundant operators or systems.

Subsurface safety valves are well known in the oil and gas industry and act as failsafes to prevent the uncontrolled release of reservoir fluids in the event of a worst-case-scenario disaster. Typical subsurface safety valves are flapper-type valves that are opened and closed with the help of a flow tube moving telescopically within the associated production tubular. The flow tube is often controlled hydraulically from the surface and is forced into its open position using a piston and rod assembly that may be hydraulically charged via a control line linked to a hydraulic manifold or control panel at the well surface. When sufficient hydraulic pressure is conveyed to the subsurface safety valve via the control line, the piston and rod assembly forces the flow tube downward, which causes the flapper to move downward to the open position. When the hydraulic pressure is removed from the control line, the flapper can move into its closed position.

Some safety valves are arranged thousands of feet underground and are therefore required to traverse thousands of feet of production tubulars, including any turns and/or twists formed therein. Consequently, during its descent downhole, the control line for an associated safety valve may undergo a substantial amount of vibration or otherwise sustain significant damage thereto. In extreme cases, the control line may be severed or one of the connection points for the control line may become inadvertently detached and/or damaged either at a surface well head or at the safety valve itself, thereby rendering the safety valve potentially powerless and inoperable. Moreover, during prolonged operation in downhole environments that exhibit extreme pressures and/or temperatures, the hydraulic actuating mechanisms used to move the flow tube may fail due to mechanical failures such as seal wear and the like. As a result, some safety valves prematurely fail, thereby leading to a need for redundant safety valve operators or systems.

SUMMARY OF THE INVENTION

The present invention relates generally to operations performed and equipment utilized in conjunction with a subterranean well and, in particular, to safety valves having redundant operators or systems.

In some embodiments, a safety valve is disclosed. The safety valve may include a piston bore defined within a housing that defines a first control line port for communicably coupling a first control line to the piston bore and a second control line port for communicably coupling a second control line to the piston bore, wherein the first and second control lines convey hydraulic fluid pressure to the piston bore, a first piston assembly movably arranged within the piston bore, a second piston assembly movably arranged within the piston bore and axially spaced from the first piston assembly, the second piston assembly including a transition member arranged at a distal end thereof, a flow tube coupled to the transition member and configured to move axially within a flow passage defined in the safety valve in response to the movement of the transition member, and a valve closure device movable between an open position and a closed position and adapted to restrict fluid flow through the flow passage when in the closed position, wherein the flow tube is adapted to shift the valve closure device between its open and closed positions.

In other embodiments, a method of actuating a safety valve is disclosed. The method may include introducing hydraulic fluid pressure to a piston bore with one or both of a first control line and a second control line communicably coupled to the piston bore, the piston bore being defined within a housing which also defines a first control line port for communicably coupling the first control line to the piston bore and a second control line port for communicably coupling the second control line to the piston bore, wherein a first piston assembly and a second piston assembly are movably arranged within the piston bore, axially translating at least the second piston assembly downward within the piston bore in response to the hydraulic fluid pressure, the second piston assembly including a transition member arranged at a distal end thereof, axially displacing a flow tube with the transition member coupled thereto, the flow tube being arranged within a flow passage defined in the safety valve, and moving a valve closure device with the flow tube from a closed position which restricts fluid flow through the flow passage to an open position.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates generally to operations performed and equipment utilized in conjunction with a subterranean well and, in particular, to safety valves having redundant operators or systems.

The exemplary safety valves disclosed herein provide redundant operators or systems which cooperatively ensure that a downhole safety valve continues to operate in the event of a failure of an associated control line, piston seal, downstop, upstop, piston bore, or other controlling equipment. Moreover, since a universal operating pressure is typically maintained in the disclosed safety valve, in at least some embodiments, the safety valves disclosed herein are able to switch back and forth between the redundant systems without ceasing production operations. Accordingly, activation and switching systems for switching between the two systems may not be required, thereby minimizing the part count for the disclosed safety valves. The redundancy of the two systems are additive in addition to being independently redundant. For example, in order for gas to migrate into the first of the redundant systems, the gas must pass through multiple mechanical and dynamic seals of the first and second redundant systems.

Figure 1:
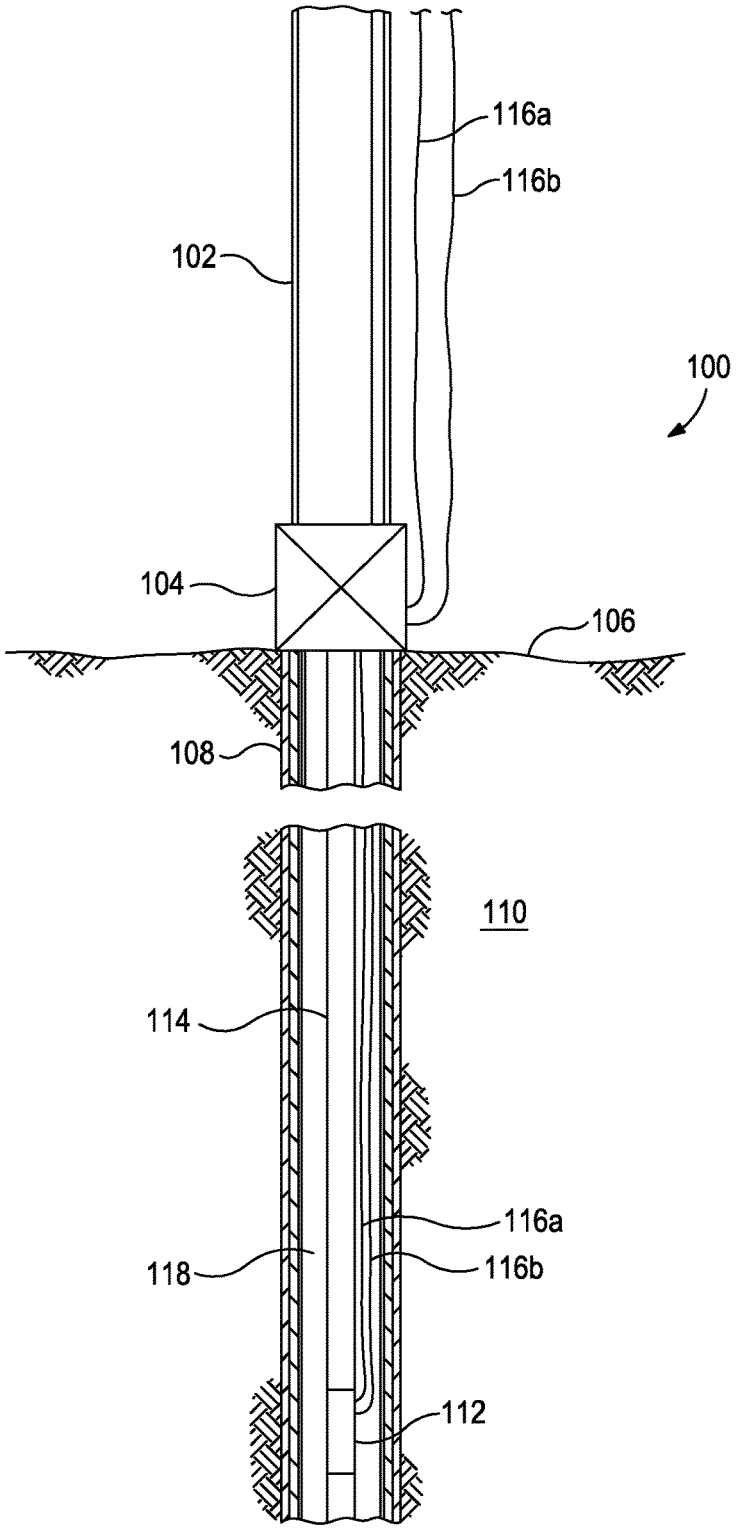
FIG. 1 illustrates a well system that incorporates one or more principles of the present disclosure, according to one or more embodiments.

Referring to FIG. 1, illustrated is a well system 100 which incorporates one or more embodiments of an exemplary safety valve 112, according to the present disclosure. As illustrated, the well system 100 may include a riser 102 extending from a wellhead installation 104 arranged at a sea floor 106. The riser 102 may extend, for example, to an offshore oil and gas platform (not shown). A wellbore 108 extends downward from the wellhead installation 104 through various earth strata 110. The wellbore 108 is depicted as being cased, but it may be an uncased wellbore 108, without departing from the scope of the disclosure. Although FIG. 1 depicts the well system 100 in the context of an offshore oil and gas application, it will be appreciated by those skilled in the art that the various embodiments disclosed herein are equally well suited for use in or on other types of oil and gas rigs, such as land-based oil and gas rigs or rigs located at any other geographical site. Thus, it should be understood that the disclosure is not limited to any particular type of well.

The well system 100 may further include a safety valve 112 interconnected with a tubing string 114 arranged within the wellbore 108 and extending from the wellhead installation 104. The tubing string 114 may be able to communicate fluids derived from the wellbore 108 to the well surface via the wellhead installation 104. In some embodiments, a first control line 116*a* and a second control line 116*b* may extend from the well surface and into the wellhead installation 104 which, in turn, conveys the control lines 116*a,b* into an annulus 118 defined between the wellbore 108 and the tubing string 114. The control lines 116*a,b* may extend downward within the annulus 118 to be eventually communicably coupled to the safety valve 112. As discussed in more detail below, the control lines 116*a,b* may be configured to actuate the safety valve 112, for example, to maintain the safety valve 112 in an open position, or otherwise to close the safety valve 112 and thereby prevent flow through the valve 112 and to the surface (e.g., a blowout in the event of an emergency).

In some embodiments, the first and second control lines 116*a,b* may be hydraulic conduits that provide hydraulic fluid pressure to the safety valve 112 in at least two independent and distinct locations. In operation, hydraulic fluid may be applied to one or both control lines 116*a,b* from a hydraulic manifold (not shown) arranged at a remote location, such as at a production platform or a subsea control station. When properly applied, the hydraulic pressure derived from one or both of the control lines 116*a,b* may be configured to open and maintain the safety valve 112 in its open position, thereby allowing production fluids to flow through the tubing string. To move the safety valve 112 from its open position and into a closed position, the hydraulic pressure in the control lines 116*a,b* may be reduced or otherwise eliminated.

While only two control lines 116*a,b* are depicted in FIG. 1, it should be understood that more than two control lines 116*a,b* may be employed, without departing from the scope of the disclosure. It should also be understood that other means, besides hydraulic fluid pressure, may be used to actuate the safety valve 112, in keeping with the principles of the disclosure. For example, the safety valve 112 could be at least partially electrically actuated, in which case one or both of the control lines 116*a,b* could be an electrical or a fiber optic line that communicates with a servo or other subsea motor or actuator. In other embodiments, the safety valve 112 could be actuated using telemetry, such as mud pulse, acoustic, electromagnetic, seismic or any other type of telemetry. In yet other embodiments, the safety valve 112 could be actuated using any type of surface or downhole power source communicably coupled to the safety valve 112 via the control lines 116*a,b*. In yet further embodiments, the safety valve 112 could be actuated remotely, such as from a location remote from the well site.

Moreover, although the control lines 116*a,b* are depicted in FIG. 1 as being arranged external to the tubing string 114, it will be readily appreciated by those skilled in the art that any hydraulic line may be used to convey actuation pressure to the safety valve 112. For example, the hydraulic line could be internal to the tubing string 114, or formed in a sidewall of the tubing string 114. The hydraulic line could extend from a remote location, such as from the earth's surface, or another location in the wellbore 108. In yet other embodiments, the actuation pressure could be generated by a pump or other pressure generation device communicably coupled to the safety valve 112 via the first and second control lines 116*a,b*.

In the following description of the representative embodiments of the disclosure, directional terms such as "above", "below", "upper", "lower", etc., are used for convenience in referring to the accompanying drawings. In general, "above", "upper", "upward" and similar terms refer to a direction toward the earth's surface along the wellbore 108, and "below", "lower", "downward" and similar terms refer to a direction away from the earth's surface along the wellbore 108.

Figure 2A:
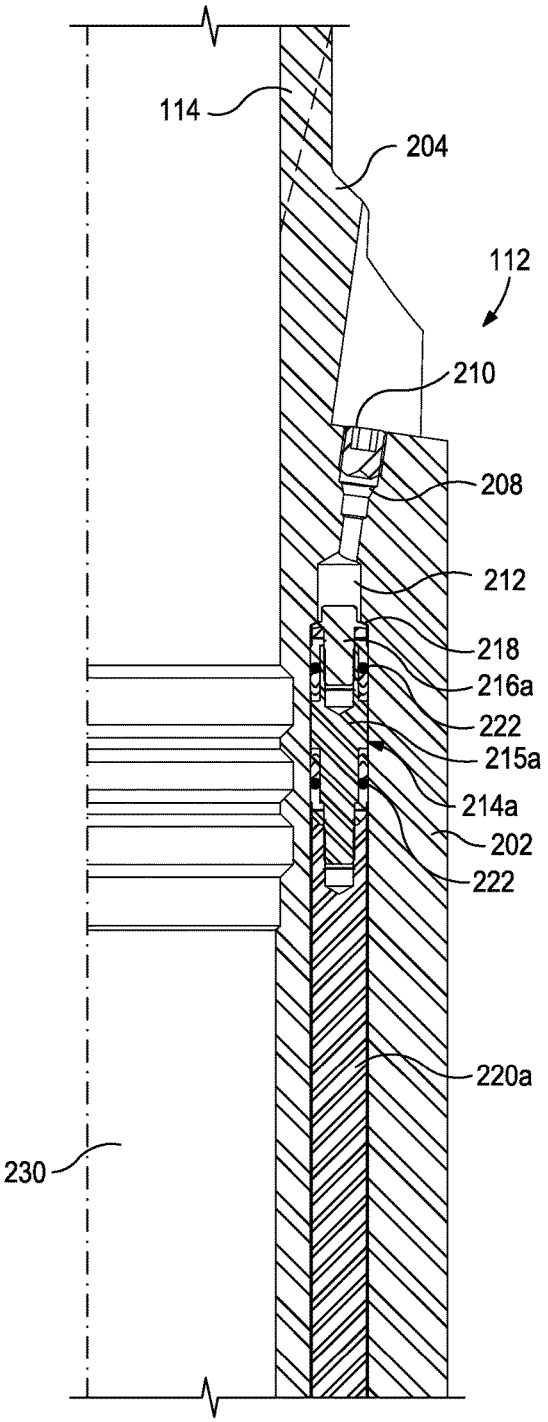
FIGS. 2A-2C illustrate successive cross-sectional views of an exemplary safety valve in its closed position, according to one or more embodiments.
Figure 2B:
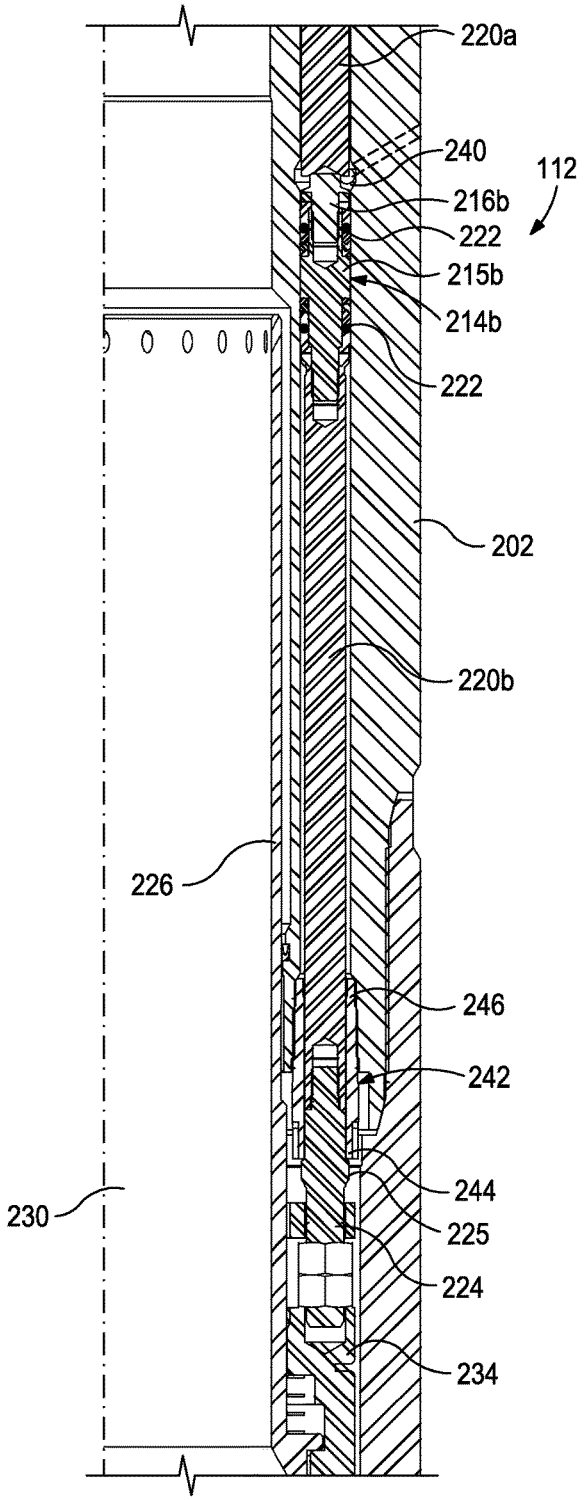
Figure 2C:
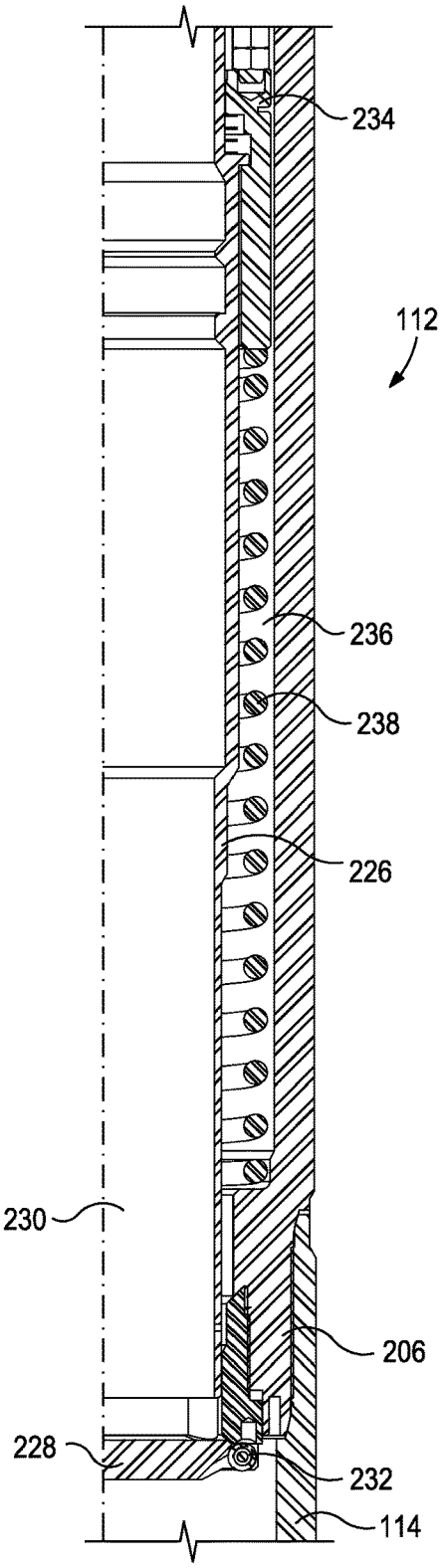

Referring now to FIGS. 2A-2C, with continued reference to FIG. 1, illustrated is an exemplary embodiment of the safety valve 112, according to one or more embodiments. In particular, the safety valve 112 is depicted in FIGS. 2A-2C in successive sectional views, where FIG. 2A depicts an upper portion of the safety valve 112, FIG. 2B depicts a middle portion of the safety valve 112, and FIG. 2C depicts a lower portion of the safety valve 112. As illustrated, the safety valve 112 may have a housing 202 that includes an upper connector 204 (FIG. 2A) and a lower connector 206 (FIG. 2C) for interconnecting the safety valve 112 with the tubing string 114.

A first control line port 208 may be defined in the housing 202 or otherwise provided for connecting the first control line 116*a* (FIG. 1) to the safety valve 112. Although the port 208 is shown in FIG. 2A as being plugged with a set screw 210 or other type of plug device, when the first control line 116*a* is appropriately connected to the first port 208, the first control line 116*a* is placed in fluid communication with a piston bore 212 and able to convey hydraulic fluid pressure thereto. The piston bore 212 may be an elongate channel defined within the housing 202 and configured to extend longitudinally along a large portion of the safety valve 112.

A first piston assembly 214*a* may be arranged within the piston bore 212 and configured to translate axially therein. The first piston assembly 214*a* may include a first piston body 215*a* and a first piston rod 220*a* coupled to a lower portion of the first piston body 215*a*. The first piston rod 220*a* may be an elongate member that extends longitudinally from the first piston body 215*a* through a portion of the piston bore 212.

The first piston assembly 214*a* may also include a first piston head 216*a* arranged at or otherwise coupled to an upper portion of the first piston body 215*a*. The piston bore 212 may define a first up stop 218 configured to mate with or otherwise bias the first piston head 216*a* when the first piston assembly 214*a* is forced upwards in the direction of the first control line port 208. In at least one embodiment, as illustrated, the first up stop 218 may be a reduced diameter radial shoulder defined in the piston bore 212 and having an axial surface configured to engage a corresponding axial surface of the first piston head 216*a*. In other embodiments, the first up stop 218 may be any device or means arranged within the piston bore 212 and configured to stop the axial translation of the first piston assembly 214 as it advances toward the first control line port 208.

In operation, when the fluid pressure or other forces within the piston bore 212 below the first piston assembly 214*a* are greater than the fluid pressure above the first piston assembly 214*a*, the first piston head 216*a* may be forced against the first up stop 218 and thereby form a mechanical seal with the first up stop 218 such that fluids (e.g., hydraulic fluids, production fluids, etc.) are unable to migrate past the first piston head 216*a* and into the first control line port 208. In some embodiments, the first piston assembly 214*a* may further include one or more dynamic seals 222 arranged radially thereabout, such as about the first piston body 215*a*. The dynamic seals 222 may be configured to further seal against any fluid pressure attempting to migrate past the first piston assembly 214*a*. In at least one embodiment, the dynamic seals 222 may be o-rings, but may otherwise be any other type of radial seal known to those skilled in the art, such as TEFLON® v-rings.

Referring to FIG. 2B, the safety valve 112 may further include a second piston assembly 214*b* arranged within the piston bore 212 and axially spaced from the first piston assembly 214*a*. Similar to the first piston assembly 214*a*, the second piston assembly 214*b* may also be configured to axially translate within the piston bore 212. The second piston assembly 214*b* may include a second piston body 215*b* and a second piston rod 220*b* coupled to a lower portion of the second piston body 215*b*. The second piston rod 220*b* may be an elongate member that extends longitudinally from the second piston body 215*b* through a portion of the piston bore 212.

The second piston assembly 214*b* may further include a second piston head 216*b* arranged at or otherwise coupled to an upper portion of the second piston body 215*b*. In some embodiments, such as when the safety valve 112 is in its closed position, as illustrated, the second piston head 216*a* may engage or otherwise be in close contact with the lower end of the first piston rod 220*a*. In some embodiments, the second piston assembly 214*b* may further include one or more dynamic seals 222 arranged radially thereabout and configured to further seal against any fluid attempting to migrate past the second piston assembly 214*b*. Again, the dynamic seals 222 may be o-rings, but may otherwise be any other type of seal known to those skilled in the art, such as TEFLON® v-rings.

The second piston assembly 214*b* may further include a transition member 224 arranged at or otherwise coupled to the bottom or distal end of the second piston rod 220*b*. The transition member 224 may define an increased diameter portion 225 which, as will be discussed in greater detail below, may serve to stop the axial movement of the transition member 224 at a predetermined location within the piston bore 212. The transition member 224 may be configured to couple the second piston assembly 214*b* to a flow tube 226 movably arranged within the safety valve 112. In at least one embodiment, the transition member 224 is coupled to the flow tube 226 via receiving flange 234 which is coupled to or otherwise forms an integral part of the flow tube 226.

The safety valve 112 may include a valve closure device 228 that selectively opens and closes a flow passage 230 extending axially through the safety valve 112. As illustrated in FIG. 2C, the valve closure device 228 may be a flapper. It should be noted that, although the safety valve 112 is depicted as being a flapper-type safety valve, those skilled in the art will readily appreciate that any type of safety valve may be employed, without departing from the scope of the disclosure. For example, in some embodiments, the safety valve 112 could instead be a ball-type safety valve, or a sleeve-type safety valve, etc.

Figure 3A:
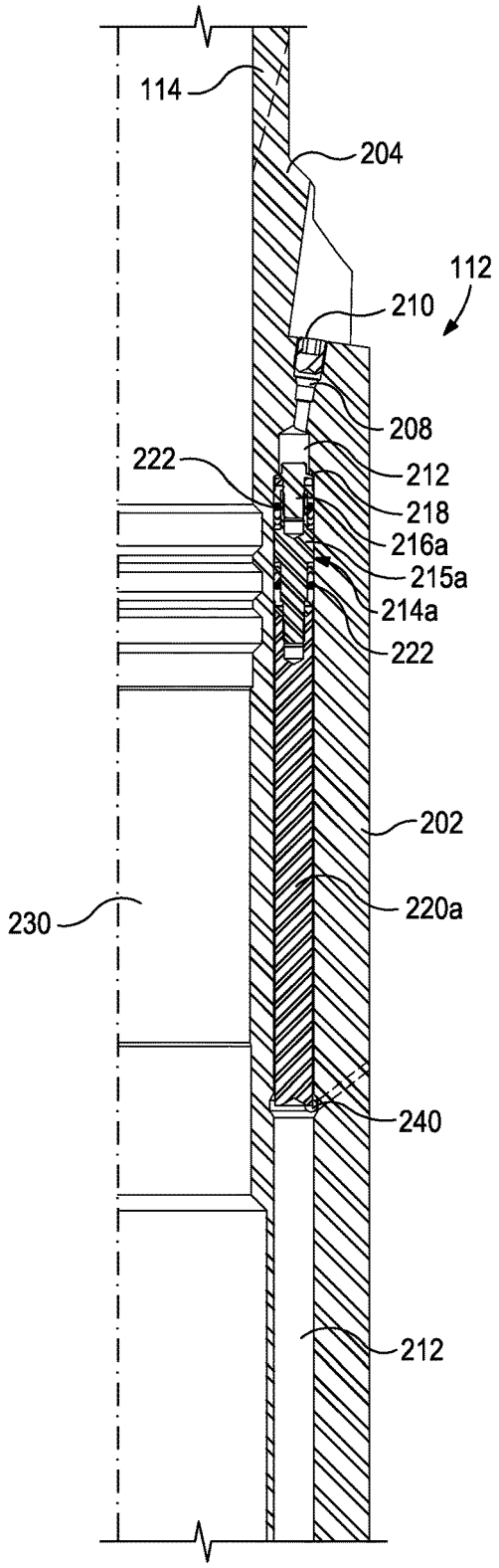
FIGS. 3A-3C illustrate successive cross-sectional views of the exemplary safety valve in its open position, according to one or more embodiments.
Figure 3B:
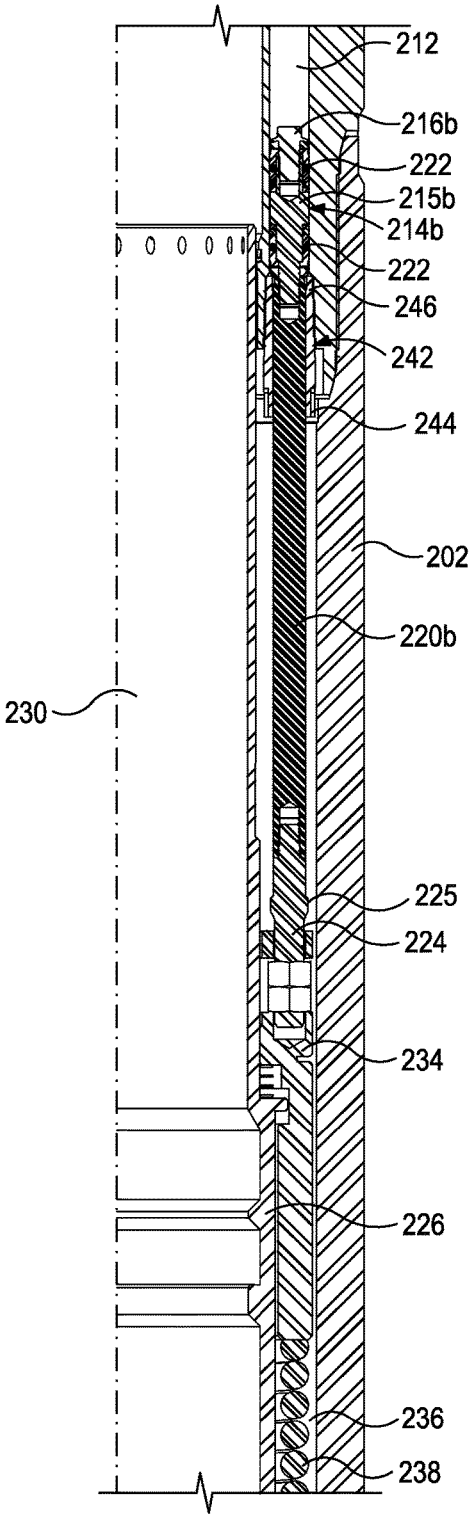
Figure 3C:
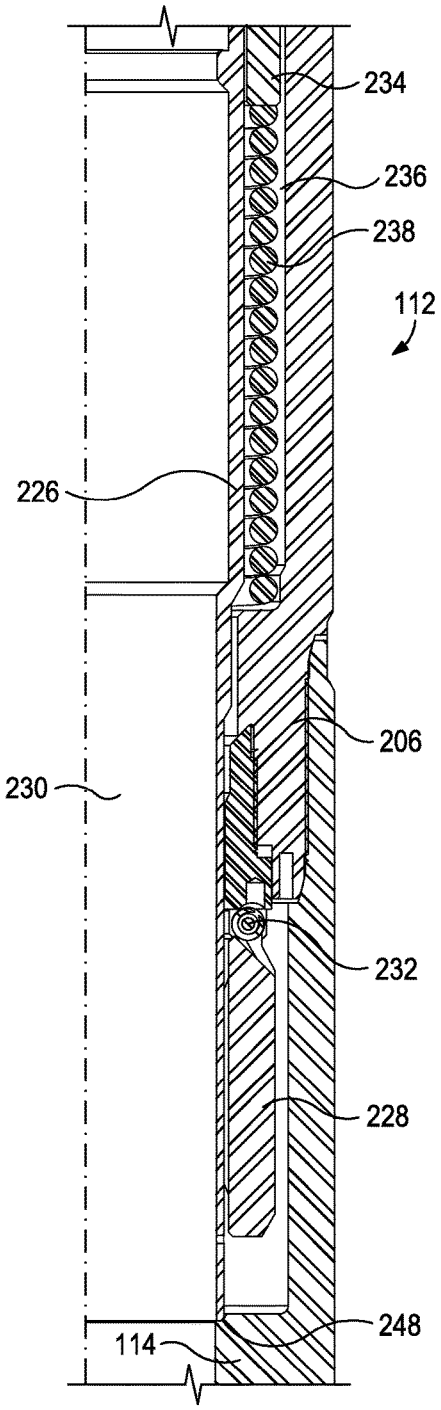

As shown in FIG. 2C, the closure device 228 is shown in its closed position, and a torsion spring 232 biases the closure device 228 to pivot to its closed position. The flow tube 226 may be used to overcome the spring force of the torsion spring 232 and thereby displace the closure device 228 between its open and closed positions. For example, when the flow tube 226 is extended to its downward position, it engages and forces the closure device 228 into its open position (as shown in FIGS. 3A-3C). On the other hand, upward displacement of the flow tube 226 will free the flow tube 226 from contact with the closure device 228 and permit the torsion spring 232 to pivot the closure device 228 back to its closed position. Accordingly, axial movement of the transition member 224 within the piston bore 212 (i.e., axial movement of the second piston assembly 214*b*) will force the flow tube 226 to correspondingly move axially within the flow passage 230, and either open the closure device 228 or allow it to close, depending on its relative position.

Referring to FIG. 2C, the safety valve 112 may further define a lower chamber 236 within the housing 202. In some embodiments, the lower chamber 236 may form part of the piston bore 212, such as being an elongate extension thereof. A spring 238 may be arranged within the lower chamber 236 and, in one or more embodiments, may be configured to bias the receiving flange 234 upwardly which, in turn, biases the second piston assembly 214*b*. Accordingly, expansion of the spring 238 will cause the second piston assembly 214*b* to move upwardly within the piston bore 212.

It should be noted that while the spring 238 is depicted as a coiled compression spring, it will be appreciated that any type of biasing device may be used instead of, or in addition to, the spring 238, without departing from the scope of the disclosure. For example, a compressed gas, such as nitrogen, with appropriate seals may be used in place of the spring 238. In other embodiments, the compressed gas may be contained in a separate chamber and tapped when needed.

Referring again to FIG. 2B, the safety valve 112 may further include a second control line port 240 defined in the housing 202. The second control line port 240 may provide a connection location for the second control line 116*b* (FIG. b) to be communicably coupled to the safety valve 112. Specifically, the second control line port 240 may place the second control line 116*b* in fluid communication with the piston bore 212 such that hydraulic fluid may be conveyed to the piston bore 212 via the second control line 116*b*. Accordingly, the second control line port 240 provides an additional or "redundant" location where hydraulic fluid may be introduced into the piston bore 212 in order to manipulate the axial position of the flow tube 226 and thereby open or close the closure device 228.

As will be appreciated by those skilled in the art, the addition of the second control line 116*b* feeding hydraulic fluid to the second control line port 240 may prove advantageous in the event the first control line 116*a* or first control line port 208 are damaged, compromised, or otherwise become inoperable. In such events, without the redundant operational advantage of the second control line 116*b* and accompanying second control line port 240, the safety valve 112 may fail to properly close, thereby risking a blowout to the surface.

In one or more embodiments, the second control line port 240 may be defined in the housing 202 such that it is able to provide hydraulic fluid pressure that acts on both the first and the second piston assemblies 214*a,b*, albeit in different axial directions within the piston bore 212. For example, fluid pressure introduced into the piston bore 212 via the second control line port 240 may serve to force the second piston assembly 214*b* downward within the piston bore 212, but simultaneously force the first piston assembly 214*a* upwards within the piston bore 212.

Still referring to FIG. 2B, the safety valve 112 may further include a down/up stop seat 242 arranged within the piston bore 212. In some embodiments, the down/up stop seat 242 may be an annular sleeve coupled or otherwise attached to the inner circumferential surface of the piston bore 212. In other embodiments, however, the down/up stop seat 242 may form an integral, machined portion of the piston bore 212. As illustrated, the down/up stop seat 242 may exhibit a reduced diameter as compared to the inner surface of the piston bore 212. As a result, the down/up stop seat 242 may provide a second up stop 244 at a lower portion thereof, and a down stop 246 at an upper portion thereof.

The second up stop 244 may be configured to engage the transition member 224, such as at an axial surface defined on the increased diameter portion 225, as the transition member 224 advances or is otherwise biased axially upwards within the piston bore 212. Consequently, the second up stop 244 may be configured to prevent the transition member 224 from axially advancing past the down/up stop seat 242, which simultaneously prevents the second piston assembly 214*b* from axially advancing further within the piston bore 212.

The down stop 246 may be configured to engage the second piston body 215*b*, such as at an axial surface defined thereon, as the second piston body 215*b* advances axially downward within the piston bore 212. Consequently, the down stop 246 may be configured to prevent the second piston body 215*b* from axially advancing past the down/up stop seat 242, which simultaneously prevents the second piston assembly 214*b* from axially advancing further within the piston bore 212.

In exemplary operation, the safety valve 112 may be properly actuated in order to open and/or close the closure device 228 using one or both of the first and second control lines 116*a,b*. For instance, providing hydraulic pressure to the piston bore 212 via the first control line 116*a* and first control line port 208 may force the first piston assembly 214*a* axially downward within the piston bore 212. As the first piston assembly 214*a* moves axially downward, the first piston rod 220*a* may engage and mechanically transfer the hydraulic force derived from the first control line 116*a* to the second piston assembly 214*b*, thereby also forcing the second piston assembly 214*b* to move axially downward within the piston bore 212.

Moving the second piston assembly 214*b* axially downward within the piston bore 212 will simultaneously displace the flow tube 226 downward via the coupling engagement between the transition member 224 and the receiving flange 234. As the flow tube 226 moves downward, it engages and opens the closure device 228 to permit production of well fluids through the flow passage 230. An example of the closure device 228 in its open position can be seen in FIG. 3C.

Moreover, as the second piston assembly 214*b* moves axially downward within the piston bore 212, the spring 238 is compressed within the lower chamber 236. In at least one embodiment, the second piston assembly 214*b* will continue its axial movement in the downward direction, thereby continuing to compress the spring 238, until the second piston body 215*b* engages the down stop 246 and effectively prevents the second piston assembly 214*b* from further downward advancement. Engagement between the second piston body 215*b* and the down stop 246 may generate a mechanical seal between the two components (e.g., metal-to-metal seal), where the mechanical seal is configured to prevent the migration of fluids (e.g., hydraulic fluids, production fluids, etc.) therethrough. In other embodiments, however, as best seen in FIG. 3C, the bottom portion of the flow tube 226 may engage or otherwise mate with a radial shoulder 248 defined in the housing 202. Similar to the down stop 246, the radial shoulder 248 may prevent the second piston assembly 214*b* from continuing to move axially downward.

Upon reducing or eliminating the hydraulic pressure provided via the first control line 116*a*, the upwardly biasing force of the spring 238 may be configured to displace the first and second piston assemblies 214*a,b* upwards in the piston bore 212. In at least one embodiment, the second piston assembly 214*b* will continue its axial movement in the upward direction until the transition member 224 engages the second up stop 244 and effectively prevents the second piston assembly 214*b* from further upward movement. Engagement between the transition member 224 and the second up stop 244 may generate another mechanical seal between the two components, where the mechanical seal is configured to prevent the migration of fluids (e.g., hydraulic fluids, production fluids, etc.) therethrough.

In other embodiments, the first and second piston assemblies 214*a,b* will continue their axial movement in the upward direction until the first piston head 216*a* of the first piston assembly 214*a* engages the first up stop 218 and effectively prevents the first and second piston assemblies 214*a,b* from further upward movement in the piston bore 212. As noted above, engagement between the first piston head 216*a* and the first up stop 218 may generate yet another mechanical seal between the two components to prevent the migration of fluids (e.g., hydraulic fluids, production fluids, etc.) therethrough.

As the second piston assembly 214*b* moves axially upwards in response to the force of the spring 238, the flow tube 226 simultaneously moves upwards and out of engagement with the closure device 228. Once free from engagement with the flow tube 226, the spring force of the torsion spring 232 will bias the closure device 228 back into its closed position. The closure device 228 in its closed position is best seen in FIG. 2C.

Referring now to FIGS. 3A-3C, with continued reference to FIGS. 2A-2C, exemplary operation of the safety valve 112, according to one or more additional embodiments is disclosed. In some applications, it may be desirable to have a second or redundant system or operator configured to actuate the safety valve 112 independent of the first control line 116*a*. This may prove especially advantageous in the event the first control line 116*a* becomes severed or otherwise inoperable, and thereby unable to hydraulically pressurize the piston bore 212 as generally described above. As depicted in FIGS. 3A-3C, the second control line 116*b* as coupled to the safety valve 112 at the second control line port 240 may serve as a redundant system or operator configured to actuate the safety valve 212 independent of (or in conjunction with) the first control line 116*a*, and thereby be able to properly open and close the closure device 228.

In exemplary operation, the hydraulic pressure provided to the piston bore 212 via the second control line 116*b* at the second control line port 240 may force the second piston assembly 214*b* axially downward within the piston bore 212. The hydraulic pressure applied at the second control line port 240 may simultaneously impinge upon the lower portion of the first piston rod 220*a*, thereby forcing the first piston assembly 214*a* in the upward direction within the piston bore 212, and/or otherwise forcing the first piston head 216*a* into engagement with the first up stop 218. Again, the mechanical engagement between the first piston head 216*a* and the first up stop 218 may provide a mechanical seal configured to prevent the migration of fluids therethrough.

As the second piston assembly 214*b* moves axially downward within the piston bore 212, the flow tube 226 will simultaneously be displaced downward. As the flow tube 226 moves downward, it engages and opens the closure device 228 to permit production of well fluids through the flow passage 230. Moreover, downward movement of the second piston assembly 214*b* compresses the spring 238 within the lower chamber 236. As described above, the second piston assembly 214*b* may continue its axial movement in the downward direction until the second piston body 215*b* engages the down stop 246 and effectively prevents the second piston assembly 214*b* from further downward advancement. In other embodiments, however, the bottom portion of the flow tube 226 may engage or otherwise mate with the radial shoulder 248 defined in the housing 202, thereby preventing the second piston assembly 214*b* from continuing to move axially downward.

Upon reducing or eliminating the hydraulic pressure provided via the second control line 116*b*, the spring 238 may force the second piston assembly 214*b* back upwards in the piston bore 212, which will simultaneously move the flow tube 226 upwards and out of engagement with the closure device 228. Once free from engagement with the flow tube 226, the closure device 228 may be biased into its closed position with the spring force of the torsion spring 232. The second piston assembly 214*b* may continue moving axially upwards until the transition member 224 engages the second up stop 244 and effectively prevents the second piston assembly 214*b* from further upward movement. In other embodiments, the second piston assembly 214*b* may continue its axial movement in the upward direction until the second piston head 216*b* engages the bottom portion of the first piston rod 220*a*, which forces the first piston assembly 214*a* into increased engagement with the first up stop 218 and effectively prevents the first and second piston assemblies 214*a,b* from further upward movement in the piston bore 212.

Those skilled in the art will readily recognize the several possible configurations for proper actuation and operation of the exemplary safety valve 112 configured with a redundant operating system, as generally disclosed herein. For example, the safety valve 112 may properly operate while both the first and the second control lines 116*a,b* are active and positively providing hydraulic fluid to the piston bore 212. The safety valve 112 may also properly operate when only the first control line 116*a* is active, but the second control line 116*b* is inoperable or otherwise non-functional. Likewise, the safety valve 112 may properly operate when only the second control line 116*b* is active, but the first control line 116*a* is inoperable or otherwise non-functional. The safety valve 112 may further be able to properly operate in the event that at least one of the first or second control lines 116*a,b* is active, but one or more of the piston bore 212, the first up stop 218, the dynamic seals 222, and the transition member 224 (i.e., the second up stop 244 and/or the down stop 246) are damaged or otherwise non-functional. Other combinations will be apparent to those skilled in the art.

At least another advantage of the disclosed safety valve 112 is that the operating pressure between the first and second control lines 116*a,b* would remain the same, thereby allowing a user to switch back and forth between either operating system. As a result, complex and often unreliable activation and/or switching systems are not required in the disclosed safety valve 112, and thus the part count for the safety valve 112 is kept to a minimum (i.e., part count is typically perceived to be inversely related to reliability).

Moreover, the redundancy of the two systems are additive in addition to being independently redundant. For example, when operating with the first control line 116*a* as the active control line, in order for fluids to migrate into the first control line 116*a* through the piston bore 212, the fluid is required to traverse multiple dynamic seals 222 on each of the first and second position bodies 215*a,b*, the second up stop 244, and the first up stop 218.

Another advantage of the disclosed safety valve 112 is the ability to retrofit existing, commercially-available safety valve systems to include the redundant operating system.

As used herein, the term "dynamic seal" is used to indicate a seal that provides pressure isolation between members that have relative displacement therebetween, for example, a seal which seals against a displacing surface, or a seal carried on one member and sealing against the other member, etc. A dynamic seal may comprise a material selected from the following: elastomeric materials, non-elastomeric materials, metals, composites, rubbers, ceramics, derivatives thereof, and any combination thereof. A dynamic seal may be attached to each of the relatively displacing members, such as a bellows or a flexible membrane. A dynamic seal may be attached to neither of the relatively displacing members, such as a floating piston.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A safety valve, comprising:

a piston bore defined within a housing that defines a first control line port for communicably coupling a first control line to the piston bore and a second control line port for communicably coupling a second control line to the piston bore, wherein the first and second control lines are independent from each other to independently convey hydraulic fluid pressure to the piston bore;

a first piston assembly actuatable by at least one of the first and second control lines, and movably arranged within the piston bore;

a second piston assembly actuatable by at least one of the first and second control lines independently from the first piston assembly, movably arranged within the piston bore, and axially spaced from the first piston assembly, the second piston assembly including a transition member arranged at a distal end thereof;

a flow tube coupled to the transition member and configured to move axially within a flow passage defined in the safety valve in response to movement of the transition member; and a valve closure device movable between an open position and a closed position and adapted to restrict fluid flow through the flow passage when in the closed position, wherein the flow tube is adapted to shift the valve closure device between open and closed positions.

2. The safety valve of claim 1, wherein the piston bore defines an up stop configured to bias the first piston assembly when the first piston assembly is forced toward the first control line port.

3. The safety valve of claim 2, wherein engagement between the up stop and the first piston assembly generates a mechanical seal therebetween.

4. The safety valve of claim 1, further comprising one or more dynamic seals arranged about the first and/or the second piston assemblies.

5. The safety valve of claim 1, further comprising a spring arranged within the piston bore and configured to bias the second piston assembly upwardly within the piston bore.

6. The safety valve of claim 1, wherein the first control line port provides hydraulic fluid pressure via the first control line that forces the first piston assembly downward within the piston bore which thereby biases the second piston assembly downward within the piston bore.

7. The safety valve of claim 1, wherein the second control line port provides hydraulic fluid pressure via the second control line that forces the first piston assembly toward the first control line port and forces the second piston assembly downward within the piston bore.

8. The safety valve of claim 1, further comprising a down/up stop seat arranged within the piston bore and providing an up stop at a lower portion thereof and a down stop at an upper portion thereof.

9. The safety valve of claim 8, wherein the transition member engages the up stop as the second piston assembly moves upwards within the piston bore and thereby stops axial advancement of the second piston assembly.

10. The safety valve of claim 9, wherein engagement between the up stop and the transition member generates a mechanical seal therebetween.

11. The safety valve of claim 8, wherein the second piston assembly engages the down stop as the second piston assembly moves downward within the piston bore and thereby stops axial advancement of the second piston assembly.

12. The safety valve of claim 1, wherein the safety valve is configured to open and/or close the valve closure device using one or both of the first and second control lines.

13. A method of actuating a safety valve, comprising:

introducing hydraulic fluid pressure to a piston bore with one or both of a first control line and a second control line, the first and second control lines being positioned independently from each other and independently communicably coupled to the piston bore, the piston bore being defined within a housing which also defines a first control line port for communicably coupling the first control line to the piston bore and a second control line port for communicably coupling the second control line to the piston bore, wherein a first piston assembly and a second piston assembly are each independently actuatable by at least one of the first and second control lines, and movably arranged within the piston bore;

axially translating at least the second piston assembly downward within the piston bore in response to the hydraulic fluid pressure, the second piston assembly including a transition member arranged at a distal end thereof;

axially displacing a flow tube with the transition member coupled thereto, the flow tube being arranged within a flow passage defined in the safety valve; and moving a valve closure device with the flow tube from a closed position which restricts fluid flow through the flow passage to an open position.

14. The method of claim 13, wherein introducing the hydraulic fluid pressure to the piston bore further comprises, introducing the hydraulic fluid to the piston bore with only the first control line.

15. The method of claim 14, further comprising:

forcing the first piston assembly downward within the piston bore; and biasing the second piston assembly with the first piston assembly, thereby axially translating the second piston assembly downward within the piston bore.

16. The method of claim 13, wherein introducing the hydraulic fluid pressure to the piston bore further comprises, introducing the hydraulic fluid to the piston bore with only the second control line.

17. The method of claim 16, further comprising:

forcing the first piston assembly toward the first control line port; and forcing the second piston assembly downward within the piston bore.

18. The method of claim 17, further comprising:

biasing the first piston assembly with an up stop defined in the piston bore; and generating a mechanical seal between the up stop and the first piston assembly.

19. The method of claim 13, further comprising:

engaging the second piston assembly on a down stop provided at an upper portion of a down/up stop seat, the down/up stop seat being arranged within the piston bore; and generating a mechanical seal between the down stop and the second piston assembly.

20. The method of claim 13, further comprising:

reducing the hydraulic fluid pressure within the piston bore;

biasing the second piston assembly upwardly within the piston bore with a spring arranged within the piston bore;

engaging the transition member on an up stop provided at a lower portion of a down/up stop seat; and generating a mechanical seal between the up stop and the transition member.

21. A method of actuating a safety valve where a first control line communicably coupled to the safety valve at a first control line port becomes inoperable, comprising:

introducing hydraulic fluid pressure to a piston bore with a second control line, the second control line being positioned independently from the first control line, and independently communicably coupled to the piston bore, the piston bore being defined within a housing which also defines a second control line port for communicably coupling the second control line to the piston bore, wherein a first piston assembly and a second piston assembly are each independently actuatable by at least one of the first and second control lines, and movably arranged within the piston bore;

axially translating the second piston assembly downward within the piston bore in response to the hydraulic fluid pressure, the second piston assembly including a transition member arranged at a distal end thereof;

axially displacing a flow tube with the transition member coupled thereto, the flow tube being arranged within a flow passage defined in the safety valve; and moving a valve closure device with the flow tube from a closed position which restricts fluid flow through the flow passage to an open position.

22. The method of claim 21, further comprising:

forcing the first piston assembly toward the first control line port defined in the housing; and forcing the second piston assembly downward within the piston bore.

23. The method of claim 22, further comprising:

biasing the first piston assembly with an up stop defined in the piston bore; and generating a mechanical seal between the up stop and the first piston assembly.

24. The method of claim 23, further comprising:

engaging the second piston assembly on a down stop provided at an upper portion of a down/up stop seat, the down/up stop seat being arranged within the piston bore; and generating a mechanical seal between the down stop and the second piston assembly.

25. The method of claim 23, further comprising:

reducing the hydraulic fluid pressure within the piston bore;

biasing the second piston assembly upwardly within the piston bore with a spring arranged within the piston bore;

engaging the transition member on an up stop provided at a lower portion of a down/up stop seat; and generating a mechanical seal between the up stop and the transition member.

* * * * *